US005765928A

United States Patent [19]

Wilkerson

[11] Patent Number: 5,765,928

[45] Date of Patent: Jun. 16, 1998

[54] METHOD OF CONSTRUCTING A REUSABLE IN-LINE SKATE WHEEL

[76] Inventor: Mark Kendall Wilkerson, 1497 S. Krameria St., Denver, Colo. 80224

[21] Appl. No.: 531,538

[22] Filed: Sep. 19, 1995

[51] Int. Cl.[6] ..... B60B 3/08

[52] U.S. Cl. ..... 301/5.3; 301/64.7; 152/403

[58] Field of Search ..... 301/5.3, 5.7, 64.7, 301/64.4; 152/323, 382, 393, 394, 395, 396, 397, 398, 402, 403; 280/11.22, 11.23

[56] References Cited

U.S. PATENT DOCUMENTS

| | | | |
|---|---|---|---|
| 687,721 | 12/1901 | Bryant | 301/5.3 |
| 801,263 | 10/1905 | Peard | 301/5.3 |
| 2,262,714 | 11/1941 | Ware | 301/5.3 |
| 2,692,801 | 10/1954 | Rosenberg | 152/323 X |
| 2,871,061 | 1/1959 | Behm | 301/5.3 |
| 3,382,009 | 5/1968 | Hawley et al. | 304/64.4 |
| 3,827,792 | 8/1974 | Hollins | 152/403 X |
| 4,090,283 | 5/1978 | Wooley | 301/5.3 |
| 4,153,303 | 5/1979 | Tanner | 152/323 X |
| 5,211,213 | 5/1993 | Hicks | 152/323 |
| 5,275,473 | 1/1994 | Hicks | 301/64.7 X |
| 5,308,152 | 5/1994 | Ho | 301/5.3 |
| 5,312,844 | 5/1994 | Gonsior et al. | 301/59 X |
| 5,470,086 | 11/1995 | Peterson et al. | 301/5.4 X |
| 5,536,074 | 7/1996 | Hsu et al. | 301/5.3 |

FOREIGN PATENT DOCUMENTS

| | | | |
|---|---|---|---|
| 2603883 | 8/1978 | Germany | 301/5.7 |

*Primary Examiner*—Russell D. Stormer
*Attorney, Agent, or Firm*—Edwin H. Crabtree; Ramon L. Pizarro; Donald W. Margolis

[57] ABSTRACT

A method of constructing an in-line skate wheel provides a hub assembly that is entirely reusable after a perimeter tire section is worn and disposed of. This wheel assembly creates an entrapment of component forms within this tire section that is locked together when hub halves are fasteners together as a hub assembly. These individual wheel components require the minimum of materials necessary to perform their tasks thereby reducing wheel weight. The preferred embodiment of these leaner components further promotes the efficient consumption of the tire profile during skating which reduces the cost of servicing worn wheels through the replacement of only these leaner tire sections.

15 Claims, 5 Drawing Sheets

METHOD OF CONSTRUCTING A REUSABLE IN-LINE SKATE WHEEL

BACKGROUND OF THE INVENTION

1. Field of the Invention

The present Invention relates to the wheels used for in-line roller skating. Specifically, the invention relates to a tire section that entraps a reusable hub assembly whereby this configuration of components is suitable for use as an in-line skate wheel.

2. Prior Art

In the early 1980's, in-line skating has become popular as a supplemental training device for ice skaters during the warm summer months. The popularity of this novel training device quickly turned out to have a much broader appeal as a recreational activity and sport. The in-line skating industry has been steady to develop new skates, wheels and accessory designs to fill this market. Most pairs of in-line skates consist of 8 to 10 wheels that after being partially worn are unsalvageable and entirely disposed of.

Generally, most in-line skate wheels are of similar design and manufacture. This typical wheel design is best represented in "Method of Producing Polyurethane Injection Molded in-line Skate Wheels" of S & W Plastics Inc., U.S. Pat. No. 5,312,844. Whereby a polyurethane tire is permanently molded around a solid plastic hub. This design creates wheels that after the polyurethane tire becomes partially worn must be entirely disposed of with no possibility of salvaging the unused internal hub.

Recently, Core Speed Wheels has begun manufacture of a wheel design based on a single central ball bearing. This bearing is held between two reusable plastic hub triangles that have their corners screwed onto both sides of three flanges projecting from the inside of a solid plastic hub ring. This hub ring is permanently molded into a polyurethane tire similar to the method of the above U.S. Pat. No. 5,312,844. While this design does allow the reuse of the two triangular bearing holders it still does not prevent the needless disposal of the unworn plastic hub ring molded to the worn outer tire.

The latest wheel product trends for in-line skates would seem to indicate a market demand for wheels with lighter total weight, a relative increase of massing toward the wheels perimeter and the need for a broader selection of tire compounds for specific skating applications.

Whatever the precise merits, features and advantages of the above cited references, there is no known in-line skate wheel that does not have the tire element permanently molded to some part of an internal hub component. This prevents the salvage and reuse of the entire hub assembly when the exhausted outer tire is disposed of creating an unwelcome and, as will be demonstrated by the present invention, unnecessary contribution to the municipal waste stream.

SUMMARY OF THE INVENTION

The present invention provides an in-line skate wheel which does not require the permanent molding of a tire section onto an internal hub assembly and instead creates this perimeter connection through the insertion, entrapment and locking of ridged hub forms within mating surfaces of an elastic perimeter tire. The sectional contours of the interior of this elastic tire are shaped to distort, receive and then due to material memory enclose around the perimeter rim of the ridged hub components. These ridged hub components are then fastened together thereby locking them within the tire section making it impossible for any component of this wheel assembly to be removed or escape until the fasteners are removed during wheel servicing.

The advantages offered by a wheel design utilizing an unlockable modular hub design in accordance with the present invention are numerous. Besides allowing the reuse of the entire hub assembly once the tire is exhausted, the perimeter section of this tire is minimized by the inclusion of the entire rim section of the hub assembly which displaces the unneeded tire material to create capture within this tire section. The cross section profile of the contours that create the hub entrapment within the tire also parallel the cross section profile of the wear pattern created from in-line skating. This parallel of profiles allows each tire to be almost completely exhausted before they require replacement. This leaner and more efficiently consumed tire section creates a wheel composition with reduced total wheel weight and positions this weight further toward the perimeter, increasing skating performance while also reducing the cost of servicing only worn tires.

DETAILED DESCRIPTION

Figure 1:
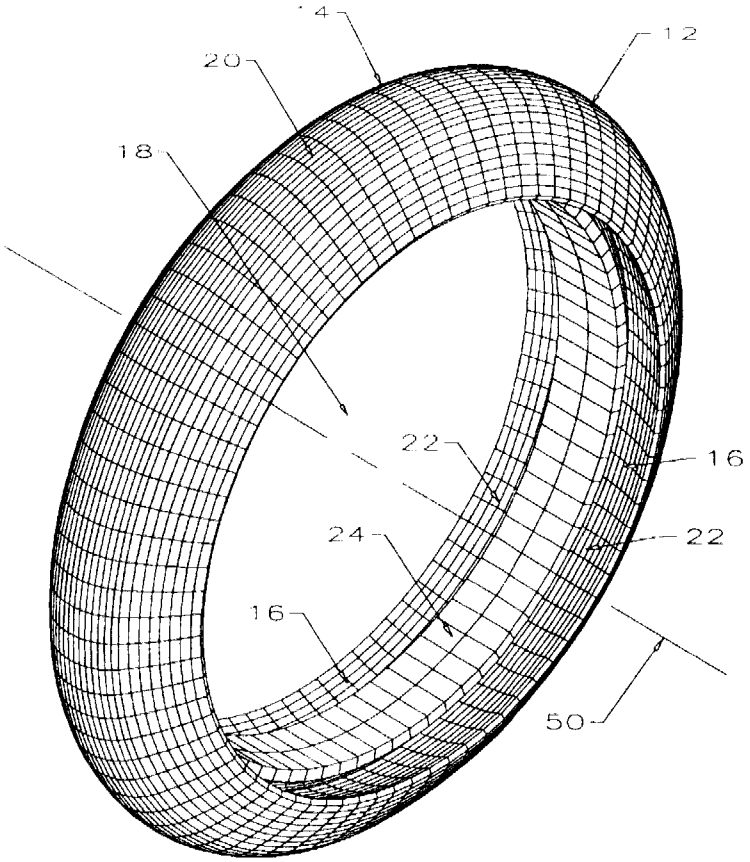
FIG. 1 is an isometric view of a tire used in the subject in-line skate wheel.

In FIG. 1, an isometric view of a tire 12 is shown. The tire 12 is part of an in-line skate wheel having a general reference numeral 10. The wheel 10 is shown in FIGS. 3–6. The tire 12 is made of a hard plastic and like materials and includes an outer circumference 14, an inner circumference 16 and an opening 18 therethrough. The outer circumference 14 has a convex surface 20. The inner circumference 16 has a concave surface 22 with a "T" shaped section 24 centered therearound and extending inwardly into the opening 18.

Figure 2:
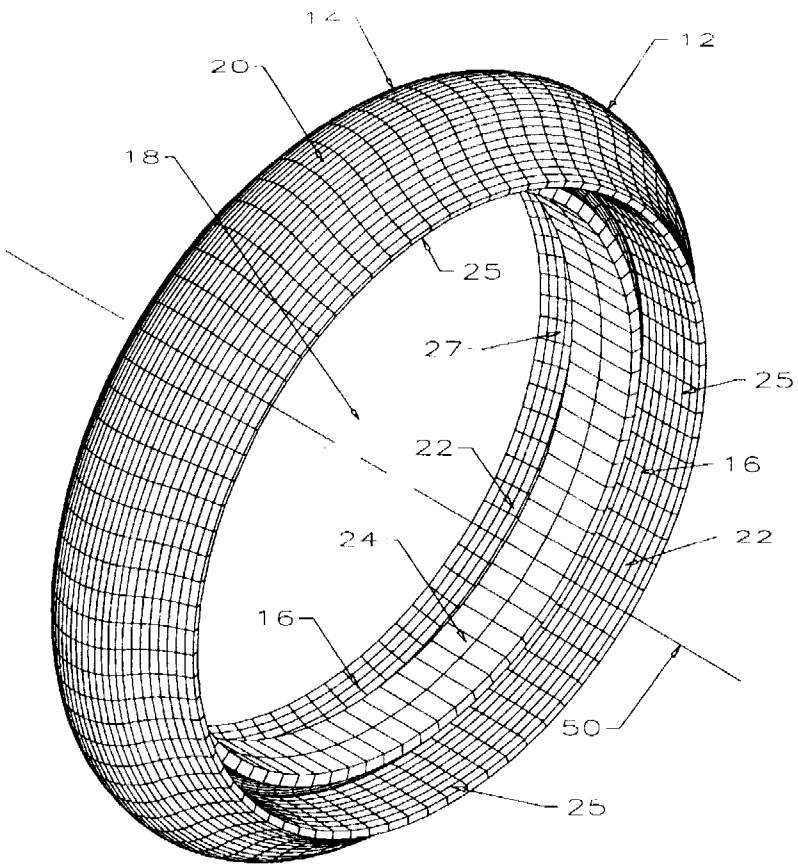
FIG. 2 is an isometric view of the tire with a portion of an inner circumference of the tire distorted.
Figure 5:
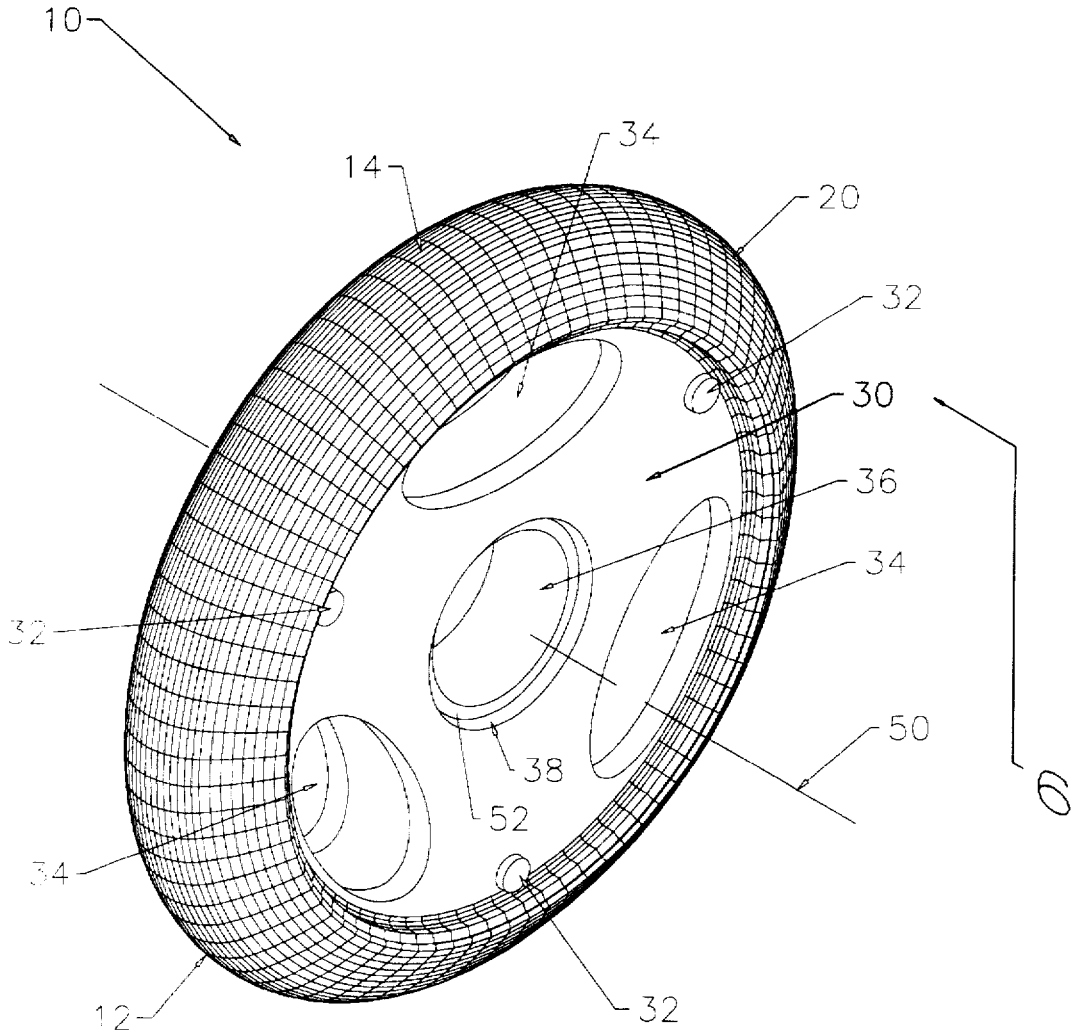
FIG. 5 is an isometric view of the in-line skate wheel completely assembled.
Figure 6:
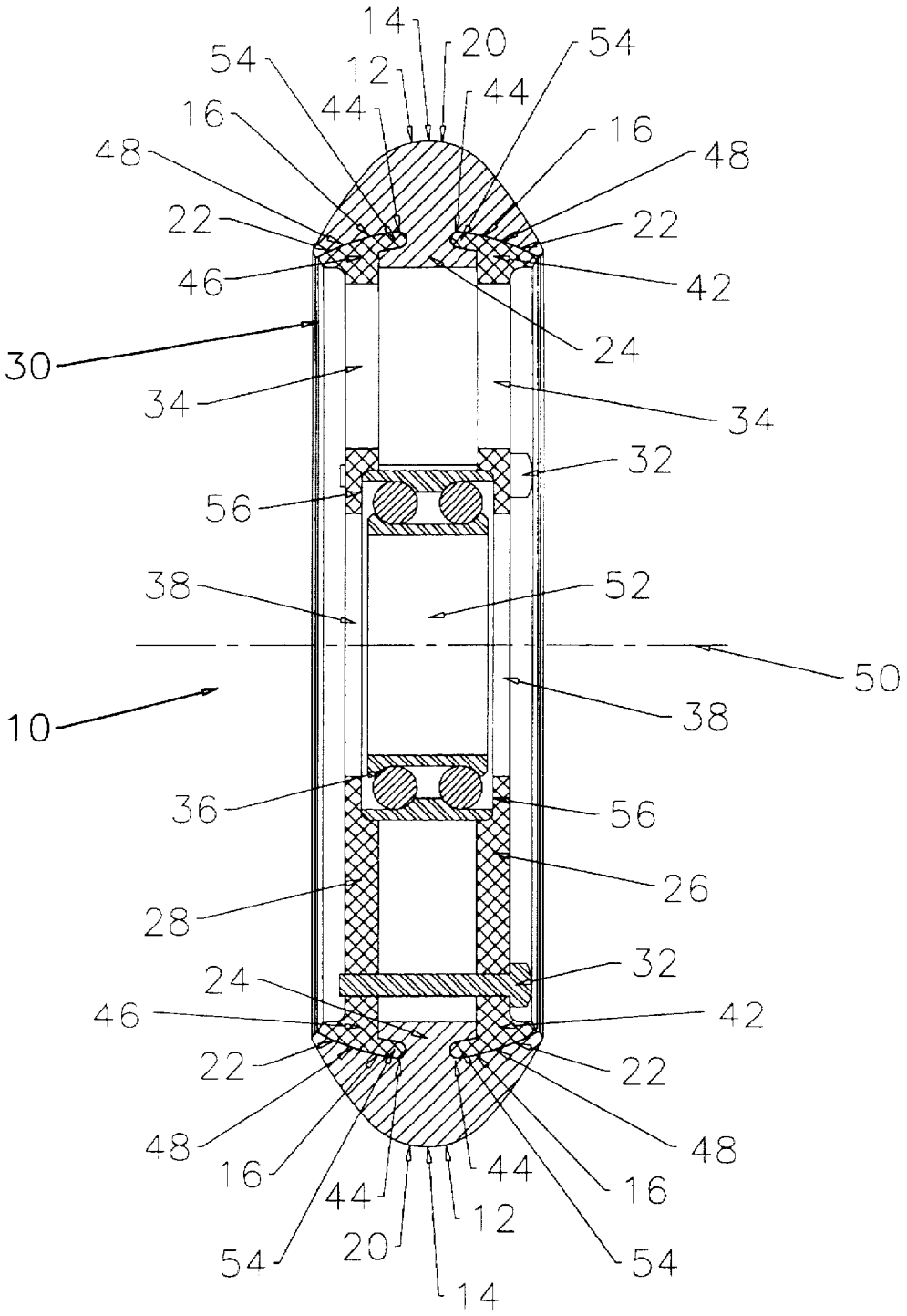
FIG. 6 is a sectional view of the assembled in-line skate wheel taken along lines 6—6 shown in FIG. 5.

In FIG. 2, an isometric view of the tire 12 is shown and similar to FIG. 1. In this view, a portion 25 of the concave surface 22 of the inner circumference 16 is distorted for receiving a first hub 26. The first hub 26 is shown in FIGS. 3–6. The first hub 26 when fastened to a second hub 28, as shown in FIGS. 5 and 6, made up a reusable internal hub assembly having a general reference numeral 30. The hub assembly 30 can be continually reused as the tire 12 becomes worn from skating and needs to be replaced.

A portion 27 of the concave surface 22 of the inner circumference 16 is distorted for receiving the second hub 28 inside the tire 10 prior to securing the first hub 26 to the second hub 28 as shown in FIGS. 5 and 6. The distortion of the portion 27 of the concave surface 22 is not shown in the drawings. Due to the elastic nature of the tire material, the portions 25 and 27 after being distorted retain by memory their original shape thereby helping the first and second hubs 26 and 28 to be entrapped inside the tire opening 18.

Figure 3:
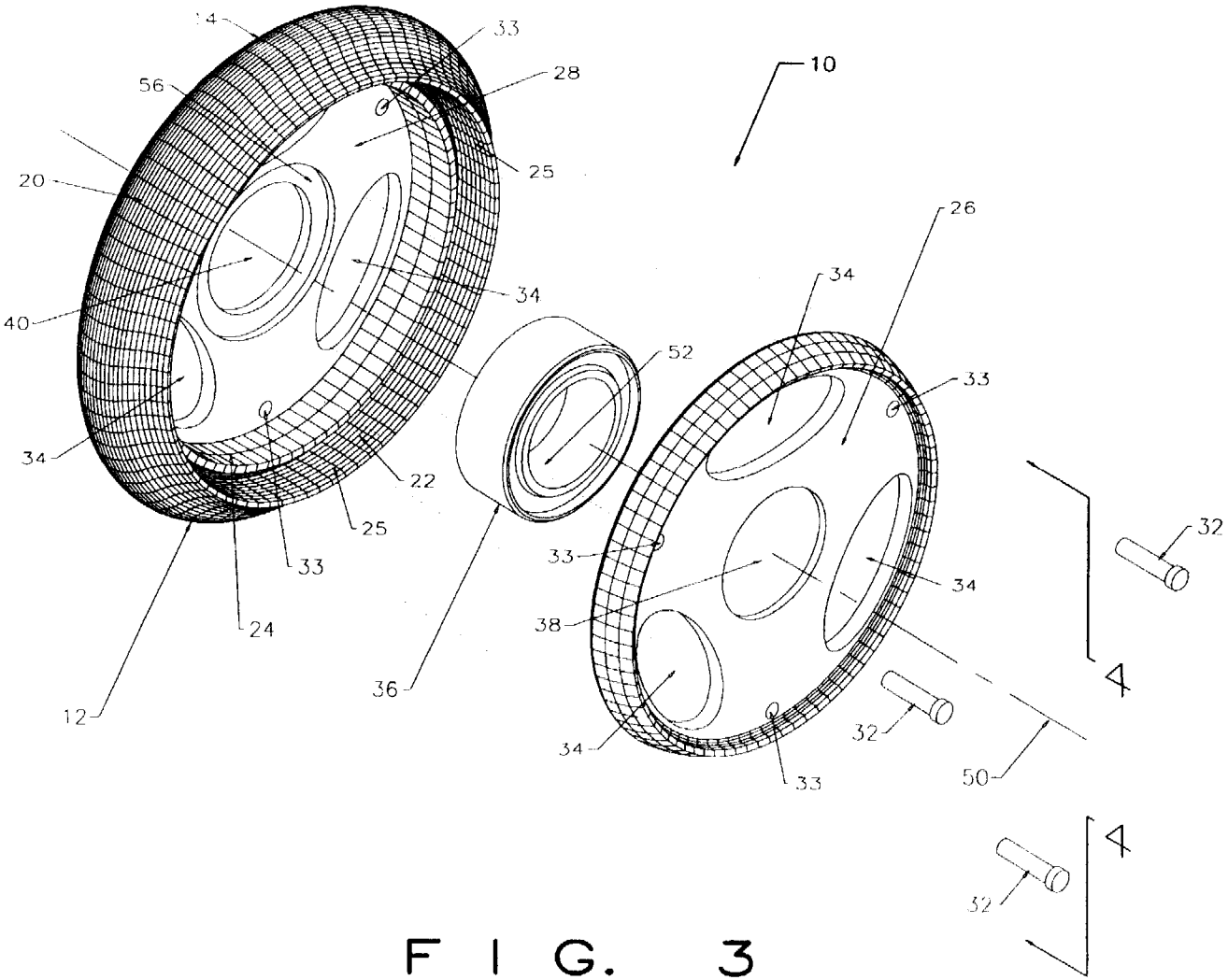
FIG. 3 is an exploded isometric view of the subject in-line skate wheel with a portion of an inner circumference of a tire distorted for receiving a first hub.

In FIG. 3, an exploded isometric view of the subject in-line skate wheel 10 is shown with the portion 25 of the inner circumference 16 of the tire 10 distorted for receiving the first hub 26. In this view, the second hub 28 has already been received inside the opposite side of the tire 12. The first hub 26 is secured to the second hub 28 by fasteners 32 received in fasteners holes 33 in the hubs 26 and 28. The first hub 26 and the second hub 28 include lightening holes 34 for helping to reduce the overall weight of the in-line skate wheel 10. Also, a ball bearing 36 is centered adjacent openings 38 and 40 in the hubs 26 and 28 and secured thereagainst.

Figure 4:
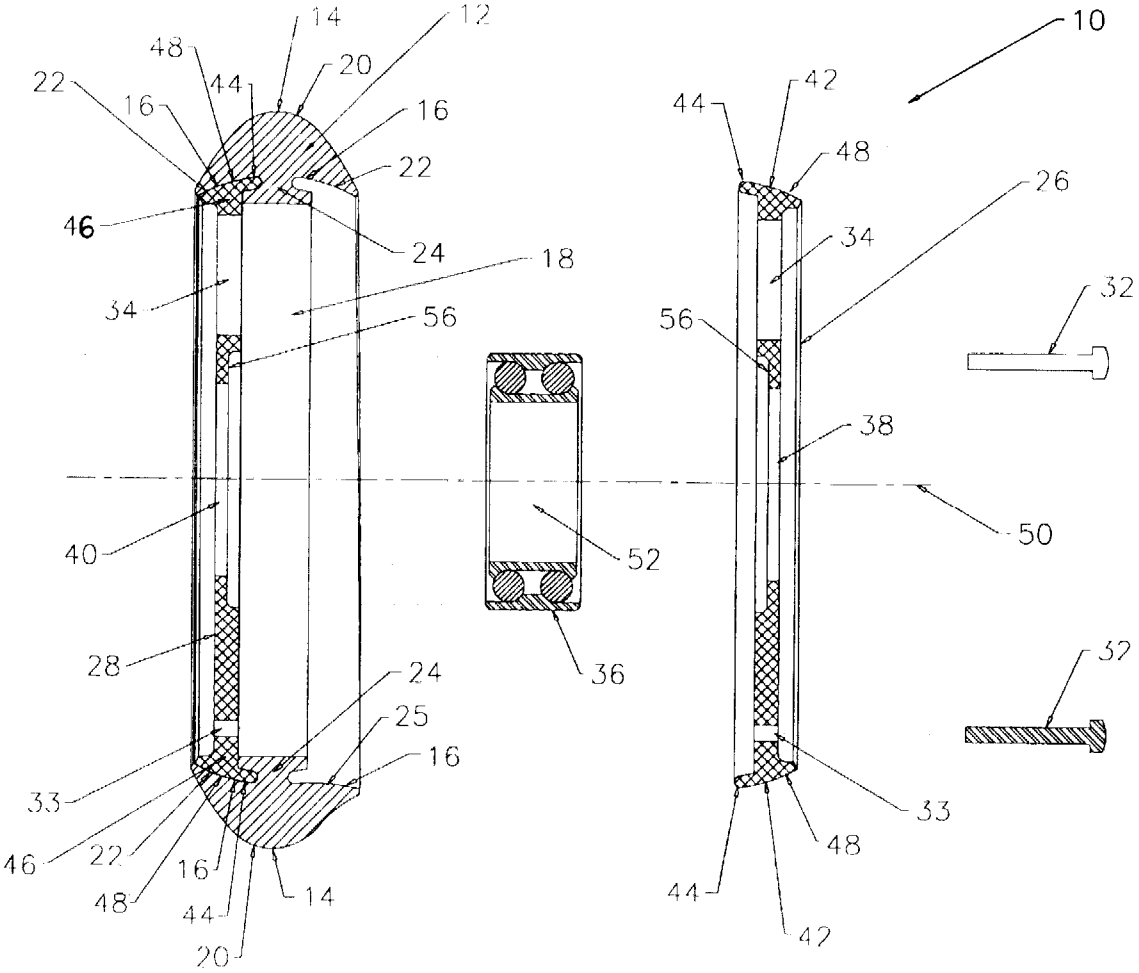
FIG. 4 is a sectional view of the in-line skate wheel taken along lines 4—4 shown in FIG. 1.

In FIG. 4, a sectional view of the in-line skate wheel 10 is shown taken along lines 4–4 shown in FIG. 3. In this view, the portion 25 of the inner circumference 16 has been distorted to help receive the first hub 26 therein. The first hub 26 has a first portion 42 of an outer circumference 44 of the hub assembly 30. The second hub 28 has a second portion 46 of the outer circumference 44. The outer circumference 44 of the hub assembly 30, made up of the first portion 42 and second portion 46, has a convex surface 48. The complete outer circumference 44 with convex surface 48 can be seen in FIG. 6 where the skate wheel 10 is shown completely assembled. The combined convex surface 48 of the first and second portions 42 and 46 of the hubs 26 and 28 engage and mate with the concave surface 22 of the inner circumference 16 of the tire 10 providing a secure fit inside the wheel 10.

In FIG. 5, an isometric view of the in-line skate wheel 10 is shown completely assembled and having a center line 50 through the openings 38 and 40 of the first and second hubs 26 and 28 and through an opening 52 in the ball bearing 36.

In FIG. 6, a sectional view of the assembled in-line skate wheel 10 is shown and taken along lines 6—6 shown in FIG. 5. In this view, the bearing 36 can be seen centered between opposite sides of the first hub 26 and the second hub 28 and secured therebetween in bearing recesses 56 in the hubs 26 and 28. Also, convex surface 48 of the outer circumference 44 of the hub assembly 30 made up of the first and second hubs 26 and 28 is shown nesting against the concave surface 22 of the inner circumference 16 of the tire 12. The first portion 42 of the first hub 26 and second portion 46 of the second hub 28 include a rounded lip 54 used for tightly engaging opposite sides of the "T" shaped section 24 when the hubs 26 and 28 are tightened on the tire 12. Through the use of the convex surface 48 of the hub assembly 30 coacting with the concave surface 22 of the tire 12 and the "T" section 24, the hub assembly 30 is held securely on the tire 12. When the tire 12 needs to be replaced, the fasteners 32 are quickly removed and the hub assembly 30 and ball bearing 36 are reused on a new tire 12.

While the invention has been particularly shown, described and illustrated in detail with reference to the preferred embodiments and modifications thereof, it should be understood by those skilled in the art that equivalent changes in form and detail may be made therein without departing from the true spirit and scope of the invention as claimed, except as precluded by the prior art.

I claim:

1. A method of assembling an in-line skate wheel used for in-line skating, the skate wheel having a tire having a convex surface about its outer circumference and a concave surface within its inner circumference and a hub assembly with a convex surface about its outer circumference, the hub assembly having a first hub and a second hub, the first hub having a first portion of the convex surface about its circumference, the second hub having a second portion of the convex surface about its circumference, the steps comprising:

distorting outwardly a segment of one side of the inner circumference of the tire;

inserting the first hub into the distorted segment of one side of the tire with the first portion of the convex surface of the first hub engaging a segment of the inner circumference of the tire while continuing to distort the tire and inserting the remainder of the first hubs circumference until captured within the one side of the inner circumference of the tire;

distorting outwardly a segment of an opposite side of the inner circumference of the tire; and inserting the second hub into the distorted segment of the opposite side of the tire with the second portion of the convex profile of the second hub engaging a segment of the inner circumference of the tire while continuing to distort the tire and inserting the remainder of the second hubs circumference until captured within the opposite side of the inner circumference of the tire.

2. The method of assembly as described in claim 1 wherein the inner circumference of the tire includes a "T" shaped section centered therearound and extending inwardly therefrom, a portion of the first hub engaging one side of the "T" shaped section, a portion of the second hub engaging an opposite side of the "T" shaped section.

3. The method of assembly as described in claim 2 further including the step of symmetrically centering the first hub and the second hub on opposite sides of the inner concave surface of the tire when the first hub and the second hub engage opposite sides of the "T" shaped section.

4. The method of assembly as described in claim 1 further including the step of securing the first hub and the second hub together after receipt inside the tire with a plurality of fasteners.

5. An in-line skate wheel used for in-line skating, the skate wheel comprising:

a tire having an outer circumference and an inner circumference, the outer circumference having a convex surface, the inner circumference having a concave surface;

a reusable internal hub assembly having an outer circumference, the outer circumference having a convex surface, said hub assembly received inside said tire, the convex surface of the outer circumference of said hub assembly releasably engaging the inner circumference of said tire, said hub assembly including a first hub and a second hub, said first hub having a first portion of the outer circumference of said hub assembly, said second hub having a second portion of the outer circumference of said hub assembly, said first hub and said second hub having a diameter greater than a diameter of the inner circumference of said tire; and means for securing said first hub to said second hub.

6. The skate wheel as described in claim 5 wherein the inner circumference of said tire includes a "T" shaped section centered therearound and extending inwardly from the inner circumference of said tire, a portion of said first hub engaging one side of said "T" shaped section, a portion of said second hub engaging an opposite side of said "T" shaped section.

7. The skate wheel as described in claim 5 wherein said "T" shaped section provides means for symmetrically centering said first hub and said second hub on opposite sides of the inner concave circumference of said tire.

8. The skate wheel as described in claim 5 wherein said first hub and said second hub are adapted for receiving a seated ball bearing therebetween.

9. The skate wheel as described in claim 5 wherein said means for securing together said hub assembly is more than one fastener spaced on said first hub and said second hub and received through matched holes in said first and second hubs.

10. The skate wheel as described in claim 5 wherein said tire is made of a plastic material.

11. The skate wheel as described in claim 5 wherein said tire is made of a thermoplastic polyurethane.

12. The skate wheel as described in claim 5 wherein said hub assembly is made of metal.

13. The skate wheel as described in claim 5 wherein said hub assembly includes a plurality of lightening holes therearound for reducing wheel weight.

14. An in-line skate wheel used for in-line skating, the skate wheel comprising:

a destructible tire made of hard plastic and having an outer circumference and an inner circumference, the outer circumference having a convex surface, the inner circumference having a concave surface, the inner circumference having a "T" shaped section centered therearound and extending inwardly therefrom;

a reusable split hub assembly having an outer circumference, the outer circumference having a convex surface, said hub assembly received inside said tire, a portion of said split hub assembly engaging opposite sides of said "T" shaped section of said tire, said split internal hub assembly including a first hub and a second hub, said first hub having a first portion of the convex surface, said second hub having a second portion of the convex surface, the first portion of said first hub and the second portion of said second hub engaging the inner concave surface of said tire and seated on opposite sides of said "T" shaped section, said first hub and said second hub having a diameter greater than a diameter of the inner circumference of said tire; and means for securing said first hub to said second hub.

15. The skate wheel as described in claim 14 wherein said means for securing is a plurality of fasteners equally spaced on said hub assembly and received through holes in said hub assembly.

* * * * *